US005421907A

United States Patent [19]

Nieendick et al.

[11] Patent Number: 5,421,907

[45] Date of Patent: Jun. 6, 1995

[54] PROCESS FOR COLD CLEANING OIL-CONTAMINATED METAL SURFACES WITH 2-ETHYLHEXYL ESTERS OF FATTY ACIDS

[75] Inventors: Claus Nieendick, Krefeld; Karl Schmid, Mettmann; Heinz Mueller, Monheim; Claus-Peter Herold, Mettmann, all of Germany

[73] Assignee: Henkel Kommanditgesellschaft auf Aktien, Duesseldorf, Germany

[21] Appl. No.: 142,390

[22] PCT Filed: May 13, 1992

[86] PCT No.: PCT/EP92/01044

§ 371 Date: Nov. 19, 1993

§ 102(e) Date: Nov. 19, 1993

[30] Foreign Application Priority Data

May 21, 1991 [DE] Germany ..... 41 16 580.2

[51] Int. Cl.[6] ..... C23G 5/032

[52] U.S. Cl. ..... 134/40; 134/2; 134/41

[58] Field of Search ..... 252/89.1, 174.19, 174.21, 252/173, 544; 134/2, 38, 40, 41, 42

[56] References Cited

U.S. PATENT DOCUMENTS

| | | | |
|---|---|---|---|
| 4,311,531 | 1/1982 | Bege et al. | 134/10 |
| 4,518,585 | 5/1985 | Greene et al. | 424/130 |
| 4,612,058 | 9/1986 | Geke et al. | 134/38 |
| 4,704,225 | 11/1987 | Stoufer | 252/153 |
| 5,100,697 | 3/1992 | Nielsen | 427/133 |

FOREIGN PATENT DOCUMENTS

| | | |
|---|---|---|
| 0498545 | 8/1992 | European Pat. Off. . |
| 1792455 | 11/1971 | Germany . |
| 3537619 | 4/1987 | Germany . |
| 3915010 | 11/1990 | Germany . |
| 9003419 | 4/1990 | WIPO . |
| 9008603 | 8/1990 | WIPO . |

OTHER PUBLICATIONS

"Guerbet Alcohols, A Versatile Hydrophobe", A. J. O'Lenick, Jr. and R. E. Bilbo, *Soap/Cosmetics/Chemical Specialties*, p. 52 Apr. (1987).

*Primary Examiner*—Paul Lieberman
*Assistant Examiner*—Lorna M. Douyon
*Attorney, Agent, or Firm*—Wayne C. Jaeschke; Norvell E. Wisdom, Jr.; Real J. Grandmaison

[57] ABSTRACT

2-Ethylhexyl esters of fatty acids, optionally mixed with emulsifiers, solubilizers, corrosion inhibitors, and/or water, are useful as low viscosity agents for the cold cleaning of metal surfaces contaminated mainly with oil. Such agents are non-toxic when inhaled and completely biodegradable.

11 Claims, No Drawings

PROCESS FOR COLD CLEANING OIL-CONTAMINATED METAL SURFACES WITH 2-ETHYLHEXYL ESTERS OF FATTY ACIDS

FIELD OF THE INVENTION

This invention relates to the use of fatty acid-2-ethylhexyl esters as cold cleaning agents for predominantly oil-contaminated metal surfaces and to preparations containing these esters.

STATEMENT OF RELATED ART

Cold cleaning is a much-used process for the pretreatment and care of materials or end products. It is generally used to remove fats, oils, tar, bitumen, lubricants, waxes and similar hydrophobic materials from hard surfaces, particularly metal surfaces. However, other materials such as, for example, sand, dust, corrosion products or residues of various solvents may also be present among the substances to be removed. Cold cleaning is generally carried out at temperatures in the range from 10° to 40° C., the workpieces to be cleaned being washed with the cold cleaner and immersed, sprinkled, sprayed or otherwise contacted with the preparation.

Suitable cold cleaning preparations are halogenated hydrocarbons, such as for example 1,1,1-trichloroethane or methylene chloride. However, substances of this type are unsafe both for reasons of industrial hygiene and for ecological reasons and therefore necessitate elaborate safety measures and recovery measures for protecting human beings and the environment.

Accordingly, gasoline distillates are preferably used instead of halogenated hydrocarbons for cold cleaning. Although they are ecologically safer, gasoline distillates have a comparatively poor cleaning effect. Accordingly, it is proposed in German patent application DE 35 37 619 A1 to use 0.2 to 6% by weight solutions of fatty alkyl esters containing a total of 12 to 40 carbon atoms in gasoline distillates as cold cleaning preparations. Although the cleaning effect of preparations such as these is entirely satisfactory, serious doubts still exist for reasons of industrial hygiene and ecology, because the presence of gasoline distillates in the preparations on the one hand represents a potential inhalation-toxicity hazard and, on the other hand, contributes to serious COD pollution of wastewaters because of the poor biodegradability of such distillates.

DESCRIPTION OF THE INVENTION

Object of the Invention

Accordingly, the, problem addressed by the present invention was to provide new cold cleaning preparations for metal surfaces which would be free from the disadvantages mentioned above.

SUMMARY OF THE INVENTION

The present invention relates; to the use of fatty acid-2-ethylhexyl esters, optionally in admixture with emulsifiers, solubilizers, corrosion inhibitors and/or water, as cold cleaning preparations for predominantly oil-contaminated metal surfaces.

Although the suitability of fatty alkyl esters for cold cleaning is known in principle, it has surprisingly been found that a particularly advantageous cleaning effect can be obtained with fatty acid-2-ethylhexyl esters, optionally in combination with emulsifiers, solubilizers and corrosion inhibitors and/or water. The advantage of the invention is, above all, that there is no need to use gasoline distillates. Fatty acid-2-ethylhexyl esters and the preparations containing them are not toxic on inhalation, are completely biodegradable and have low viscosities. Since fatty acid-2-ethylhexyl esters have a particularly high affinity for metal surfaces, the surfaces are not completely degreased; instead a fine ester film is formed and affords additional desirable protection against corrosion.

Fatty acid-2-ethylhexyl esters are known substances which may be obtained by the relevant methods of preparative organic chemistry, for example by esterification of fatty acids with 2-ethylhexanol in the presence of p-toluene sulfonic acid or tin filings.

DESCRIPTION OF PREFERRED EMBODIMENTS

According to the invention, 2-ethylhexyl esters of fatty acids containing 6 to 22 carbon atoms and 0 or 1 double bond may be used. Typical examples are the 2-ethylhexyl esters of caproic acid, caprylic acid, capric acid, lauric acid, myristic acid, palmitic acid, stearic acid, oleic acid, elaidic acid, petroselic acid, arachic acid, gadoleic acid, behenic acid or erucic acid. As usual in oleochemistry, esters of technical fatty acid fractions such as accumulate in the pressure hydrolysis of natural fats and oils, for example coconut oil, palm oil, palm kernel oil, rapeseed oil, sunflower oil or beef tallow, may also be used. 2-ethylhexyl esters of $C_8$–$C_{14}$ fatty acids, more particularly $C_{12}$–$C_{14}$ coconut oil fatty acid, are preferred.

The present invention also relates to cold cleaning preparations for predominantly oil-contaminated metal surfaces containing:

a) fatty acid-2-ethylhexyl esters and, optionally,
b1) emulsifiers,
b2) solubilizers,
b3) corrosion inhibitors and/or
b4) water.

Preparations having a particularly good cleaning effect are distinguished by the fact that they contain 2-ethylhexyl esters of fatty acids containing 6 to 22 carbon atoms and, more particularly, 8 to 14 carbon atoms and 0 or 1 double bond.

The fatty acid-2-ethylhexyl esters (component a) may be used either on their own or in combination with one or more of the ingredients mentioned (components b1 to b4). For example, the 2-ethylhexyl ester may be marketed in 100% by weight form or in the form of a concentrate having an ester content of at least 15% by weight and diluted in situ with water to a cleaning concentration of, for example, 1 to 10% by weight, based on the preparation. However, preparations containing at least one emulsifier, solubilizer and/or corrosion inhibitor in addition to the 2-ethylhexyl esters are preferred.

In the following, emulsifiers are understood to be adducts of on average 1 to 10 moles of ethylene and/or propylene oxide with fatty alcohols containing 6 to 22 carbon atoms and 0 or 1 double bond.

The adducts in question are nonionic surfactants obtained by the known and industrially established process of base-catalyzed alkoxylation of compounds containing acidic hydrogen atoms. It is preferred to use adducts of on average 1 to 10 and preferably 2 to 5 moles of ethylene oxide with $C_8$–$C_{18}$ and preferably $C_8$–$C_{14}$ fatty alcohols and adducts of on average 2 to 10 moles of ethylene oxide and 1 to 5 moles of propylene oxide with $C_{12}$–$C_{18}$ fatty alcohols. The emulsifiers may be present in the preparations according to the invention in quantities of 1 to 25% by weight and preferably in quantities of 3 to 10% by weight, based on the preparation as a whole.

Suitable solubilizers are substances selected from the group consisting of $C_{16}$–$C_{20}$ Guerbet alcohols, butyl diglycol and reaction products of, on average, 1 to 10 moles of ethylene oxide with fatty acid glyceride esters containing 6 to 22 carbon atoms and 0 or 1 double bond in the fatty acid component.

Guerbet alcohols are branched primary alcohols obtained, for example, by self-condensation of linear primary alcohols with, for example, 8 to 10 carbon atoms in the presence of alkali metal catalysts [*Soap, Cosm. Chem. Spec.*, 52 (1987)].

The reaction products of ethylene oxide with fatty acid glyceride esters are also known. In the production of these substances, ethylene oxide units are introduced into the ester bond of natural or synthetic mono-, di- or tri-glycerides or are added onto free hydroxyl groups present. Typical examples are reaction products of 1 to 10 moles and preferably 2 to 5 moles of ethylene oxide with coconut oil, palm oil, palm kernel oil, rapeseed oil, sunflower oil, beef tallow, lauric acid monoglyceride, $C_{12}$–$C_{14}$ coconut oil fatty acid monoglyceride, stearic acid monoglyceride or oleic acid monoglyceride. The solubilizers may be present in the preparations according to the invention in quantities of 1 to 25% by weight and preferably in quantities of 3 to 10% by weight, based on the preparation as a whole.

Corrosion inhibitors in the context of the invention are fatty acid alkanolamides containing 12 to 22 carbon atoms and 0 or 1 double bond in the fatty acid component and 2 to 4 carbon atoms in the alkanol component. Typical examples are lauric acid ethanolamide, stearic acid dipropanolamide, $C_{12}$–$C_{14}$ coconut oil fatty acid triethanolamide and, in particular, oleic acid ethanolamide. The corrosion inhibitors, which may also have a co-emulsifying effect, may be present in the preparations according to the invention in quantities of 1 to 10% by weight and preferably in quantities of 2 to 5% by weight, based on the preparation as a whole.

The preparations may be marketed in water-free form and diluted in situ to an in-use concentration of, for example, 1 to 10% by weight, based on the preparation. However, water-containing concentrates or aqueous solutions already diluted to the in-use concentration may also be prepared.

The preparations according to the invention are suitable, for example, for the washing of engines and engine parts. They may also be used for cleaning metal surfaces before they are primed, painted or coated. The cold cleaners according to the invention may also be used for the reliable removal of preservatives for the purpose of transportation, for example preserving wax on the surface of newly manufactured automobiles. Other applications for the preparations according to the invention include the cold cleaning of various surfaces, for example glass, ceramic products, such as tiles, various painted, enameled or coated surfaces and surfaces of man-made materials.

In combination with typical anionic, nonionic or amphoteric surfactants, such as for example alkyl sulfates, alkylether sulfates, alkyl benzenesulfonates, olefin sulfonates, alpha-sulfofatty acid esters, alkane sulfonates, isethionates, taurides, sarcosides, ether carboxylic acids, alkyl glucosides, alkyl amidobetaines or imidazolinium betaines, the preparations are also suitable for the production of hand washing pastes.

The following Examples are intended to illustrate the invention without limiting it in any way.

EXAMPLES

The cleaning effect of the preparations according to the invention was tested in an immersion test on iron test plates which had previously been treated with a standard soil.

a) Preparation of the standard soil (in accordance with *Bundesamt fur Wehrtechnik und Beschaffung* [German Federal Office for Defense Technology and Supply] TL 6850-017):

100 g of a mixture containing 30 g of iron(Ill) oxide, 20 g of engine oil 20 W/50, 20 g of gear oil SE90, 10 g of carbon black, 10 g of sea sand, 9 g of lubricating grease (antifriction bearing grease MO) and 1 g of bentonite were dispersed in 50 ml of carbon tetrachloride.

b) Effectiveness test

Iron test plates (0.2×2.5×5 cm) were immersed in the standard soil, dried in air for at least 1 h at 20° C. and then weighed. The soiled iron plates were then immersed for 5 minutes at 20° C. in quantities of 50 ml of formulations A, B, C and D (for composition, see Table 1). The dripping-wet test plates were then sprayed with 100 ml of tap water and dried for 5 minutes in air and for 20 minutes in a drying oven at 110° C. After redrying in air for 30 minutes, the test plates were reweighed.

TABLE 1

Composition of the exemplary formulations
Quantities in % by weight

| Formulation | A | B | C | D |
|---|---|---|---|---|
| EHK | 24 | 17 | 94 | 94 |
| G20 | 5 | 7 | — | — |
| DO4 | 4 | — | — | — |
| LS6 | 10 | 5 | — | — |
| LS45 | — | — | 5 | 2 |
| LS54 | — | — | — | 3 |
| RHE | — | 7 | — | — |
| BDG | 3 | — | — | — |
| COD | 6 | 4 | 1 | 1 |
| $H_2O$ | 46 | 60 | — | — |

The ratio of soil removed to the soil originally applied was expressed as the % cleaning effect (% C), see Table 2.

TABLE 2

Cleaning effect of the exemplary formulations

| Formulation | Cleaning effect % C |
|---|---|
| A | 95.4 |
| B | 93.2 |
| C | 95.6 |
| D | 96.8 |

List of the substances used

EHK: $C_{12}$–$C_{14}$ Coconut oil fatty acid 2-ethylhexyl ester

G20: $C_{20}$ Guerbet alcohol

DO4: Adduct of, on average, 4 moles of ethylene oxide with octanol

LS6: Adduct of, on average, 6 moles of ethylene oxide with a $C_{12/14}$ coconut oil fatty alcohol LS45: An adduct of, on average, 4 moles of propylene oxide and 5 moles of ethylene oxide with a $C_{12/14}$ coconut oil fatty alcohol LS54: Adduct of, on average, 5 moles of propylene oxide and 4 moles of ethylene oxide with a $C_{12/14}$ coconut oil fatty alcohol RHE: Adduct of, on average, 5 moles of ethylene oxide with a $C_{12/14}$ coconut oil fatty acid triglyceride BDG: Butyl diglycol COD: Oleic acid diethanolamide

The invention claimed is:

1. In a process for cold cleaning predominantly oil-contaminated metal surfaces, the improvement comprising contacting the oil-contaminated metal surfaces with a preparation consisting essentially of 15 to 100% by weight fatty acid-2-ethylhexyl esters, the balance, if any, being at least one of emulsifiers, solubilizers, corrosion inhibitors and water, said preparation begin free of gasoline distillates.

2. A process as claimed in claim 1 wherein said 2-ethylhexyl esters of fatty acids contain 6 to 22 carbon atoms and 0 or 1 double bond.

3. A process as claimed in claim 2, wherein the emulsifiers are selected from the group consisting of adducts of 1 to 10 moles of ethylene oxide, propylene oxide, or both with fatty alcohols containing 6 to 22 carbon atoms and 0 or 1 double bond.

4. A process as claimed in claim 2, wherein the solubilizers are selected from the group consisting of $C_{16}$–$C_{20}$ Guerbet alcohols, butyl diglycol and reaction products of 1 to 10 moles of ethylene oxide with fatty acid glyceride esters containing 6 to 22 carbon atoms and 0 or 1 double bond in the fatty acid component.

5. A process as claimed in claim 2, wherein the corrosion inhibitors are selected from the group consisting of fatty acid alkanolamides containing 12 to 22 carbon atoms and 0 or 1 double bond in the fatty acid component and 2 to 4 carbon atoms in the alkanol component.

6. A process as claimed in claim 3 wherein the emulsifiers are present in quantities of 1 to 25% by weight, based on the weight of said preparation.

7. A process as claimed in claim 4 wherein the emulsifiers are present in quantities of 1 to 25% by weight, based on the weight of said preparation.

8. A process as claimed in claim 5 wherein the emulsifiers are present in quantities of 1 to 25% by weight, based on the weight of said preparation.

9. A process as claimed in claim 4 wherein the solubilizers are present in quantities of 1 to 25% by weight, based on the weight of said preparation.

10. A process as claimed in claim 4 wherein the solubilizers are present in quantities of 1 to 25% by weight, based on the weight of said, preparation.

11. A process as claimed in claim 5 wherein the solubilizers are present in quantities of 1 to 25% by weight, based on the weight of said preparation.

* * * * *